US006573038B2

(12) United States Patent
Chen et al.

(10) Patent No.: US 6,573,038 B2
(45) Date of Patent: Jun. 3, 2003

(54) HIGH CHLORIDE SILVER HALIDE ELEMENTS CONTAINING PYRIMIDINE COMPOUNDS

(75) Inventors: Shihua S. Chen, Penfield, NY (US); Roger Lok, Rochester, NY (US); Alberto M. Martinez, Rochester, NY (US); Dean H. Russell, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/872,669

(22) Filed: Jun. 1, 2001

(65) Prior Publication Data

US 2003/0082492 A1 May 1, 2003

(51) Int. Cl.[7] ..... G03C 1/34; G03C 7/32
(52) U.S. Cl. ..... 430/551; 430/614
(58) Field of Search ..... 430/614, 551

(56) References Cited

U.S. PATENT DOCUMENTS

| | | | | |
|---|---|---|---|---|
| 2,139,870 A | | 12/1938 | Wilmanns et al. | |
| 2,173,628 A | * | 9/1939 | Kendall | 430/614 |
| 3,672,891 A | | 6/1972 | Wyand et al. | |
| 3,964,912 A | | 6/1976 | Price | |
| 5,185,239 A | * | 2/1993 | Maskasky | 430/614 |
| 5,300,420 A | * | 4/1994 | Kenny et al. | 430/614 |
| 5,385,811 A | | 1/1995 | Hirano | 430/438 |
| 5,763,146 A | | 6/1998 | Reynolds et al. | 430/377 |

FOREIGN PATENT DOCUMENTS

| | | |
|---|---|---|
| EP | 0 335 107 A1 | 10/1989 |
| EP | 0 430 196 A1 | 6/1991 |
| EP | 0 533 189 A1 | 3/1993 |
| JP | 61-182038 | 8/1986 |
| JP | 62-254147 | 11/1987 |

OTHER PUBLICATIONS

D. G. Saunders, Preparation of 4–Substituted 2–Dimethylamino–5–nitro–and –5–amino–pyrimidines, Journal Chemical Society, (London), pp. 3232–3234, Feb. 24, 1956.

E. B. Knott, Colour Reactions of Reducing Pyrimidines, Journal of the Society Chemical, Ind. London Trans., vol. 60, pp. 313–314, Dec., 1941.

R. W. Henn & Sue V. Carpenter, Photographic Developing Agents: I. Pyrimidines, Photographic Science and Engineering vol. 3, No. 3, pp. 135–139, May–Jun., 1959.

Derwent German Abstract, DD 237230 A, Jul 2, 1986.

Derwent Japanese Abstract, JP 3015042 A, Jan. 23, 1991.

Derwent Japanese Abstract, JP 2294632 A, Dec. 5, 1990.

Patent Abstracts of Japan, vol. 011, No. 005 (p. 533) Jan. 8, 1987.

Patent Abstracts of Japan, vol. 012, No. 133 (p. 693) Apr. 22, 1988.

* cited by examiner

*Primary Examiner*—Richard L. Schilling
(74) *Attorney, Agent, or Firm*—Sarah Meeks Roberts

(57) ABSTRACT

A silver halide photographic element comprising a silver halide emulsion which is greater than 50 mole % silver chloride and a pyrimidine compound represented by Formula I (I)

wherein $R_1$, $R_2$, and $R_3$ are each independently a hydrogen atom or a hydroxy, alkoxy, amino, alkylamino, cyanoamino or alkyl group, and $R_4$ is a hydroxy, alkoxy, amino, alkylamino, cyanoamino or alkyl group; provided that at least one of $R_1$, $R_2$, $R_3$, and $R_4$ is a hydroxy or an amino group.

9 Claims, No Drawings

HIGH CHLORIDE SILVER HALIDE ELEMENTS CONTAINING PYRIMIDINE COMPOUNDS

FIELD OF THE INVENTION

This invention relates to the use of a certain class of pyrimidine compounds to control fog growth in silver halide photographic elements.

BACKGROUND OF THE INVENTION

The photographic industry is engaged in a continual effort to improve on the stability of its products. Stability can take at least two forms: raw stock stability or latent image stability. Each form of stability is due to a unique interaction between the components of a photographic element. Thus, compounds and processes capable of being utilized to improve one aspect of stability will not necessarily, and often do not, improve other aspects of stability.

When conventional silver halide photographic elements are exposed to actinic radiation, a record of the exposure invisible to the unaided eye is formed. This invisible record of exposure is referred to as a latent image. Formation of the latent image is believed to be the result of the interaction of silver ions with photoelectrons generated by the absorption of actinic radiation by silver halide grains. It is generally agreed that the latent image comprises minute specks of metallic silver formed in, or on, individual silver halide grains. When the exposed silver halide material is processed, a visible image is obtained.

It is known that the latent image is not permanent. The silver specks that form the latent image are metastable, and with the passage of time, they may become undevelopable. This phenomenon is termed latent image fading and manifests itself as a loss in image density in the developed image and a consequent loss in speed in the silver halide photographic material. It is equally plausible that the latent image, may, with the passage of time, grow such that some of the undevelopable silver specks become developable. In this case, the phenomenon is known as latent image gain. This manifests itself in a gain in image density and an increase in an undesirable speed gain.

Latent images of exposed high chloride emulsion photographic materials are prone to change with time if not immediately processed. When exposed color-paper products are left undeveloped, the delay following exposure (which may last from five seconds to thirty minutes) may result in a speed increase. Such increases are variable depending on the duration of the delay before processing. These increases may also vary from one color record to another, resulting in unacceptable color balances. These variabilities could degrade the quality of the image obtained and is a dissatisfier for the consumer. Hence, latent image changes are a significant problem to product builders.

However, latent image changes can be eliminated or substantially reduced by application of known latent image stabilizers, many of which function by mechanisms not completely understood. It is believed that different kinds of latent image stabilizers may function by different mechanisms. U.S. Pat. No. 5,089, 381 describes a class of mercaptotriazole latent image stabilizers and EP 0 377 889 describes a class of triazolomercaptan latent image stabilizers. U.S. Pat. No. 4,378,426 and U.S. Pat. No. 4,451,557 teach the use of alkynyl heterocycles as latent image stabilizing compounds. U.S. Pat. No. 4,948,721 teaches the use of certain benzothiazolium salts for stabilizing photographic latent images in color negative films.

Stabilization also embodies raw stock stabilization, often referred to as storage stability or raw stock keeping (RSK). This form of stabilization typically manifests itself in a photographic element's resistance to fog formation or sensitivity change during prolonged storage, particularly during prolonged storage under conditions of high temperature and relative humidity. Because of the recent increased use in the photographic industry of silver chloride emulsions, which exhibit a greater propensity for storage deterioration than silver bromide or silver iodobromide emulsions, considerable effort has gone into finding effective raw stock stabilizers.

Attempts have been made to improve raw stock stabilization by the addition of inhibitory agents to the silver halide emulsions. These fog-inhibiting agents, however, have often proved inadequate. Examples of raw stock stabilizers are described in U.S. Pat. Nos. 2,772,164; 2,819,965, 2,897,081; 2,919,985; 2,952,539, 2,981,624; 3,051,570; GB 858,326; and JP-A-094626. The compounds in these references generally comprise heterocyclic carboxy- or alkoxycarbonylalkyl mercapto structures. Still other forms of stabilizers are known in the art. U.S. Pat. No. 3,791,830, for example, describes the use of arylmercaptoethyl or arylsulfonylethyl esters of carbonthioic acids as antifoggant precursors for stabilizing a photographic element against overdevelopment. U.S. Pat. No. 4,396,707 describes the use of certain aminotriazolomercapto compounds for fog control when processing silver halide photographic element at elevated temperatures. Other alkoxycarbonylmercapto compounds are described in U.S. Pat. No. 5,081,009 and JP 63-046458 as alkali cleavable precursors to mercapto compounds in reversal reflective printing materials, or direct positive internal latent image silver halide emulsions. In U.S. Pat. No. 4,522,917 a photographic element is described which contains a compound capable of undergoing alkali hydrolysis during development to release a photographically useful group comprising an amino moiety. In U.S. Pat. No. 4,952, 491 mercaptoazoles or their precursors are described for use in tabular grain emulsions comprising at least about 50 mol % of silver chloride. These compounds, however, have been found to cause a substantial loss in emulsion sensitivity. Despite the myriad forms of stabilizers known in the art, there has yet been provided a sufficiently effective class of stabilizers that are particularly suited for the raw stock stabilization of color negative silver chloride reflective photographic elements.

Few chemicals have the ability to stabilize both the latent image and the raw stock of the silver photographic element. One exception is described in European Patent Application 0 335 107 which discloses the use of polyhydroxy aromatic compounds as suitable for control of raw stock and latent image. Another disclosure, U.S. Pat. No. 5,763,146, teaches the use of water soluble amino hexose reductones for minimizing latent image changes and from raw stock keeping.

Developing agents are chemicals used in the processing of the exposed photographic materials containing the latent image. These agents are known as developers in the photographic trade and are often added to the processing solution for reduction of the silver ion to metallic silver. Hydroxypyrimidines and aminopyrimidines have been reported as useful photographic developing agents (GB 479,446; J. Chem. Soc. (London) 3232 1956, J. Soc. Chem. Ind. London Trans., vol. 60, 313, 1941; U.S. Pat. No. 3,672,891; Photogr. Sci. Eng. vol. 3, 135, 1959, FR 2,065,793). Spectrally sensitized silver halide photographic material for laser exposure and its treatment with hydroxypyrimidinethiol developer has been claimed in JP-09185142. Hydroxymercaptopyrimidines are used in the processing of silver halide photographic materials in JP-06308679. Ruthenium complexes of pyrimidines have been reported to be useful as development accelerators in U.S. Pat. No. 3,964,912. Some of the pyrimidine developing agents exhibit strong reducing properties, i.e., they are readily oxidizable. If added directly to the silver halide emulsion prior to coating, strong reducing agents may reduce silver ion to metallic silver and cause fog, resulting in unacceptable photographic image quality.

Other uses for pyrimidines have also been claimed. Specific aminopyrimidines have been alleged as crystal habit stabilizers of high chloride emulsion grains in European Patent Application 0 430 196. Bisaminopyrimidine derivatives have been described for use in photographic films in JP 89-150264 and JP 89-117117. The use of metal complexes of pyrimidines in silver halide photographic emulsions with improved sensitivity-fog ratio has been discussed in DD 85-276156.

There continues to be a need in the photographic industry for color negative silver chloride reflective photographic elements which exhibit good raw stock keeping. There is also a need for improving the latent image stability of such photographic elements.

SUMMARY OF THE INVENTION

This invention provides a silver halide photographic element comprising a silver halide emulsion which is greater than 50 mole % silver chloride and a pyrimidine compound represented by Formula I (I)

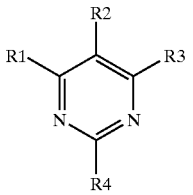

wherein $R_1$, $R_2$, and $R_3$ are each independently a hydrogen atom or a hydroxy, alkoxy, amino, alkylamino, cyanoamino or alkyl group, and $R_4$ is a hydroxy, alkoxy, amino, alkylamino, cyanoamino or alkyl group, provided that at least one of $R_1$, $R_2$, $R_3$, and $R_4$ is a hydroxy or an amino group.

The pyrimidine compounds utilized in the photographic elements of the invention provide improved raw stock keeping, particularly when the elements are stored under high temperature and humidity conditions. Additionally, certain of these pyrimidine compounds that fall within a narrow range of reducing strength are very effective at controlling short term latent image changes in silver chloride emulsions.

DETAILED DESCRIPTION OF THE INVENTION

The class of pyrimidine compounds utilized in this invention is represented by Formula (I):

(I)

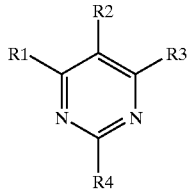

wherein $R_1$, $R_2$,and $R_3$ are each independently a hydrogen atom or a hydroxy, alkoxy, amino, alkylamino, cyanoamino, or alkyl group, and $R_4$ is a hydroxy, alkoxy, amino, alkylamino, cyanoamino, or alkyl group, provided that at least one of $R_1$, $R_2$, $R_3$, and $R_4$ must be a hydroxy or an amino group. Preferably when $R_1$, $R_2$, $R_3$, and $R_4$ are an alkyl or alkylamino group, the alkyl has 1 to 4 carbon atoms.

In a preferred embodiment at least two of $R_1$, $R_2$, $R_3$, and $R_4$ are a hydroxy or an amino group. In one suitable embodiment at least one of $R_1$, $R_2$, $R_3$, and $R_4$ is an amino group adjacent to a hydroxy group. Additionally, certain of these pyrimidines that fall within a narrow range of reducing strength, as measured by their oxidation potential, can be used for control of short term latent image changes in silver chloride emulsions. The preferred range of oxidation potential is 0.2 to 0.25 V vs. SCE (Saturated Calomel Electrode) in potassium hydrogen phthalate buffer at pH 5.50±0.1.

Examples of these pyrimidines include, but are not limited to, the following:

(A)

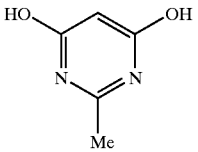

(B)

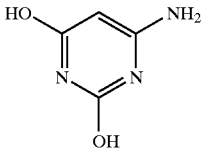

(C)

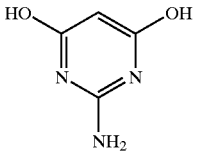

(D)

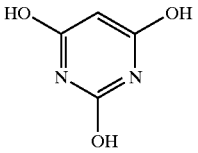

(E)

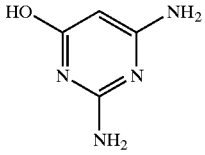

-continued
(F)
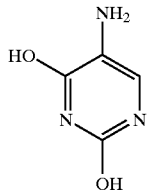
(G)
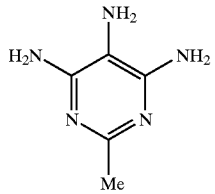
(H)
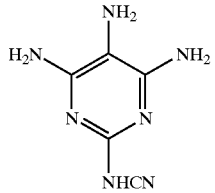
(I)
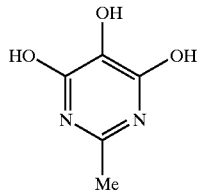
(J)
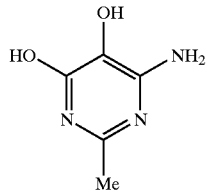
(K)
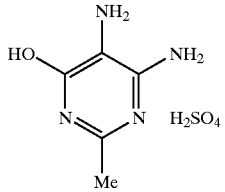
(L)
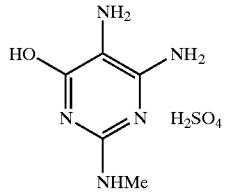
(M)
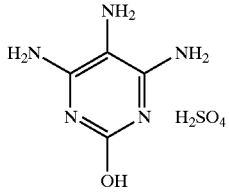
-continued
(N)
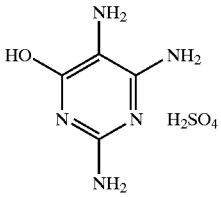
(O)
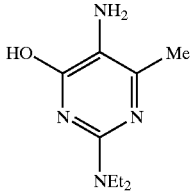
(P)
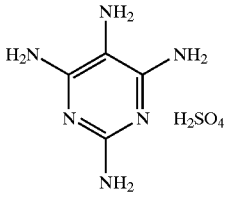
(Q)
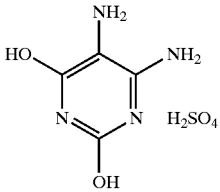
(R)
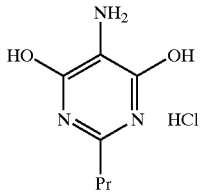
(S)
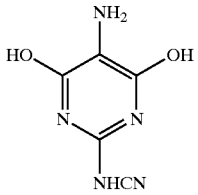
(T)
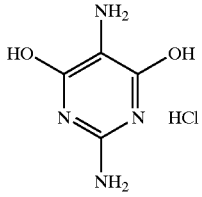
(U)
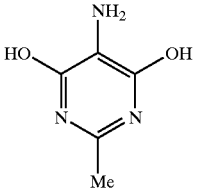

-continued (V)

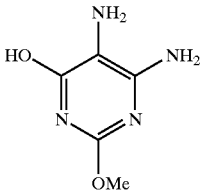

(W)

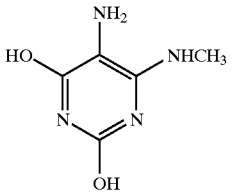

(X)

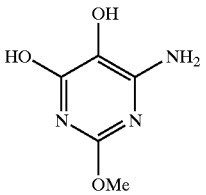

(Y)

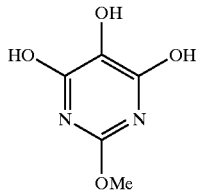

(Z)

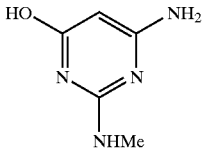

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonyl amino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido, sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl, N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl, sulfonyloxy, such as dodecylsulfonyloxy, and hexadecylsulfonyloxy sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy, amine, such as phenylanilino, 2-chloroanilino, diethylamine, dodecylamine, imino, such as 1 (N-phenylimido)ethyl, N-succinimido or 3-benzylhydantoinyl, phosphate, such as dimethylphosphate and ethylbutylphosphate; phosphite, such as diethyl and dihexylphosphite, a heterocyclic group, a heterocyclic oxy group or a heterocyclic thio group, each of which may be substituted and which contain a 3- to 7-membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium, and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc.

Pyrimidines are readily available materials. They may be synthesized from standard textbook procedures or they may be commercially available. Certain 2-alkyl and 2-aryl substituted pyrimidines may be prepared from condensation of alkyl or aryl amidine acetate with ethylcyanoacetate followed by ammonium persulfate oxidation according to the method of R. Hull in *J. Chem. Soc.* (1956) 2033.

The aminopyrimidine and hydroxypyrimidine compounds may be added either to the photographic emulsion or to the coupler dispersion using any technique suitable for this purpose. They may be dissolved in most common organic solvents, for example, methanol or acetone. They can be added to the emulsion in the form of a liquid/liquid dispersion similar to the technique used with certain couplers. They can also be added as a solid particle dispersion or in the form of a water soluble amine salt. The pyrimidine compounds may be used in addition to any conventional emulsion stabilizer or antifoggant as commonly practiced in the art. Combinations of more than one pyrimidine compound may be utilized.

Useful levels of pyrimidines of the present invention may range from 0.01 mmol to 1000 mmol per silver mole. A preferred range is from 0.1 mmol to 100 mmol per silver mole, a more preferred range is from 0.5 mmol to 50 mmol per silver mole, and the most preferred range is from 1 mmol to 10 mmol per silver mole.

The pyrimidines may be added to any layer of the photographic element where they are in reactive association with the silver halide. By "in reactive association with" it is meant that the compounds must be contained in the silver halide emulsion layer or in a layer whereby they can react or interact with, or come in contact with the silver halide emulsion. For example, the compounds can also be added to gelatin-only overcoats or interlayers.

The photographic emulsions of this invention are generally prepared by precipitating silver halide crystals in a colloidal matrix by methods conventional in the art. The colloid is typically a hydrophilic film forming agent such as gelatin, alginic acid, or derivatives thereof.

The crystals formed in the precipitation step are washed and then chemically and spectrally sensitized by adding spectral sensitizing dyes and chemical sensitizers, and by providing a heating step during which the emulsion temperature is raised, typically from 40 ° C. to 70 ° C., and maintained for a period of time. The precipitation and spectral and chemical sensitization methods utilized in preparing the emulsions employed in the invention can be those methods known in the art.

Chemical sensitization of the emulsion typically employs sensitizers such as sulfur-containing compounds, e.g., allyl isothiocyanate, sodium thiosulfate and allyl thiourea; reducing agents, e.g., polyamines and stannous salts; noble metal compounds, e.g., gold, platinum; and polymeric agents, e.g., polyalkylene oxides. As described, heat treatment is employed to complete chemical sensitization. Spectral sensitization is effected with a combination of dyes, which are designed for the wavelength range of interest within the visible or infrared spectrum. It is known to add such dyes both before and after heat treatment. After spectral sensitization, the emulsion is coated on a support. Various coating techniques include dip coating, air knife coating, curtain coating, and extrusion coating.

The pyrimidine compounds may be added to the silver halide emulsion at any time during the preparation of the emulsion, i.e., during precipitation, during or before chemical sensitization or during final melting and co-mixing of the emulsion and additives for coating. Alternatively, the pyrimidines may be added as a component to the coupler dispersion, which is simultaneously coated with the silver halide emulsion. In one preferred embodiment the pyrimidine compounds are added as an aqueous solution to the coupler dispersion.

The silver halide emulsions utilized in this invention may be comprised of, for example, silver chloride, silver bromochloride, silver iodochloride, silver bromoiodochloride and silver iodobromochloride enulsions. The silver halide emulsions are predominantly silver chloride emulsions. By predominantly silver chloride, it is meant that the grains of the emulsion are greater than about 50 mole percent silver chloride. Preferably, they are greater than about 90 mole percent silver chloride; and optimally greater than about 95 mole percent silver chloride.

It is contemplated that the predominantly silver chloride emulsions may take the form of a variety of morphologies including those with cubic, tabular and tetradecahedral grains with {111} and {100} crystal faces. The grains may take the form of any of the naturally occurring morphologies of cubic lattice type silver halide grains. Further, the grains may be irregular such as spherical grains. Additionally, these emulsions may contain iodides or bromides of less than 10% of the total halide composition.

The grains can be contained in any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin) or acid treated gelatin (pigskin gelatin) and gelatin derivatives—e.g., acetylated gelatin, phthalated gelatin and the like are specifically contemplated. When used, gelatin is preferably at levels of 0.01 to 100 grams per total silver mole The photographic elements of the invention can be black-and-white elements, single color elements, or multicolor elements. The supports utilized in this invention are generally reflective supports such as are known in the art. Multicolor elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer.

A typical multicolor photographic element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler. The element can contain additional layers, such as filter layers, interlayers, overcoat layers, subbing layers, and the like. In one suitable embodiment the pyrimidine compounds utilized in the invention are added to the yellow dye image-forming unit either in the silver halide emulsion or in the coupler dispersion.

If desired, the photographic element can be used in conjunction with an applied magnetic layer as described in

*Research Disclosure*, November 1992, Item 34390 published by Kenneth Mason Publications, Ltd., Dudley Annex, 12a North Street, Emsworth, Hampshire PO10 7DQ, ENGLAND, the contents of which are incorporated herein by reference.

In the following Table, reference will be made to (1) *Research Disclosure*, December 1978, Item 17643, (2) *Research Disclosure*, December 1989, Item 308119, (3) *Research Disclosure*, September 1994, Item 36544, and (4) *Research Disclosure*, September 1996, Item 38957, all published by Kenneth Mason Publications, Ltd., Dudley Annex, 12a North Street, Emsworth, Hampshire PO10 7DQ, ENGLAND, the disclosures of which are incorporated herein by reference. The Table and the references cited in the Table are to be read as describing particular components suitable for use in the elements of the invention. The Table and its cited references also describe suitable ways of preparing, exposing, processing and manipulating the elements, and the images contained therein. High chloride photographic elements and methods of processing such elements particularly suitable for use with this invention are described in *Research Disclosure*, February 1995, Item 37038, in *Research Disclosure*, September 1997, Item 40145 and, of particular interest, *Research Disclosure*, September 2000, Item 437013 published by Kenneth Mason Publications, Ltd., Dudley Annex, 12a North Street, Emsworth, Hampshire PO 10 7DQ, ENGLAND, the disclosures of which are incorporated herein by reference.

| Reference | Section | Subject Matter |
|---|---|---|
| 1 | I, II | Grain composition, |
| 2 | I, II, IX, X, XI, XII, XIV, XV | morphology and preparation. Emulsion preparation |
| 3 & 4 | I, II, III, IX A & B | including hardeners, coating aids, addenda, etc. |
| 1 | III, IV | Chemical sensitization and |
| 2 | III, IV | spectral sensitization/ |
| 3 & 4 | IV, V | desensitization |
| 1 | V | UV dyes, optical brighteners, |
| 2 | V | luminescent dyes |
| 3 & 4 | VI | |
| | VI | Antifoggants and stabilizers |
| 2 | VI | |
| 3 & 4 | VII | |
| 1 | VIII | Absorbing and scattering |
| 2 | VIII, XIII, XVI | materials; Antistatic layers; |
| 3 & 4 | VIII, IX C & D | matting agents |
| 1 | VII | Image-couplers and image- |
| 2 | VII | modifying couplers; Wash-out |
| 3 & 4 | X | couplers; Dye stabilizers and hue modifiers |
| 1 | XVII | Supports |
| 2 | XVII | |
| 3 & 4 | XV | |
| 3 & 4 | XI | Specific layer arrangements |
| 3 & 4 | XII, XIII | Negative working emulsions; Direct positive emulsions |
| 2 | XVIII | Exposure |
| 3 & 4 | XVI | |
| 1 | XIX, XX | Chemical processing; |
| 2 | XIX, XX, XXII | Developing agents |
| 3 & 4 | XVIII, XIX, XX | |
| 3 & 4 | XIV | Scanning and digital processing procedures |

The photographic elements may utilize any traditional support known to those skilled in the art. One conventional photographic quality paper comprises cellulose paper with polyethylene resin waterproof coatings. The support may also consist of a multilayer film of biaxially oriented polyolefin which is attached to both the top and bottom of a photographic quality paper support by melt extrusion of a polymer tie layer. The biaxially oriented films may contain a plurality of layers in which at least one of the layers contains voids. The voids provide added opacity to the imaging element. This voided layer can also be used in conjunction with a layer that contains at least one pigment from the group consisting of $TiO_2$, $CaCO_3$, clay, $BaSO_4$, ZnS, $MgCO_3$, talc, kaolin, or other materials that provide a highly reflective white layer in said film of more than one layer. The combination of a pigmented layer with a voided layer provides advantages in the optical performance of the final image. These supports are described in more detail in U.S. Pat. Nos. 5,866,282; 5,888,681; 6,030,742; 6,030,759; 6,107,014; and 6,153,351. Such biaxially oriented films may also be utilized for display materials having translucent or transparent supports.

The photographic elements comprising the radiation sensitive high chloride emulsion layers can be conventionally optically printed, or can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18, and 23.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$, and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al, *A Continuous-Tone Laser Color Printer*, Journal of Imaging Technology, Vol. 14, No. 3, June 1988, which is hereby incorporated herein by reference. A description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1.

The photographic elements can then be processed to form a visible dye image. Processing to form a visible dye image includes the step of contacting the element with a color developing agent to reduce developable silver halide and oxidize the color developing agent. Oxidized color developing agent in turn reacts with the coupler to yield a dye. With negative-working silver halide, the processing step described above provides a negative image. In one embodiment the described elements can be processed in the known color print processes such as the RA-4 process of Eastman Kodak Company, Rochester, N.Y.

The following examples illustrate the practice of this invention. They are not intended to be exhaustive of all possible variations of the invention.

EXAMPLES

Example 1

Electrochemical Methods

A Model CHI660 electrochemical analyzer (CH Instrurnents, Inc., Austin, Tex.) was employed to carry out the electrochemical measurements. Glassy carbon disk electrodes (3 mm in diameter) were used as working electrodes. A platinum wire served as counter electrode. Potentials were recorded against the saturated calomel electrode (SCE). 0.1 M potassium hydrogen phthalate, pH 5.50±1 was used as supporting electrolyte. Osteryoung Square-Wave voltammetry (OSWV) and cyclic voltammetry (CV) were used to determine the oxidation potentials of chemicals. Between each measurement, the following electrode treatment was applied: cyclic scan from 0.0 V to −0.6 V for 20 cycles at 1 V/s. In some occasions, the glassy carbon electrode was repolished with 0.05 μm alumina slurry or cleaned with acetone to remove the absorbed electrochemical reaction products on the electrode surface. Sample solutions were prepared with the electrolyte to a concentration level of approximately 1.0 mM. The testing solution was purged with high purity nitrogen gas for approximately 5 minutes prior to the experiments and a nitrogen blanket was maintained on top of the solution during the course of the experiments. Measurements were carried out at ambient temperature of 25±1° C.

CV scan rates (v): 20, 50 and 100 mV/s. $E^{\circ\prime}$ was estimated from the intercept of Ep~vs. $v^{1/2}$ plot for irreversible reactions. For reversible reactions, $E^{\circ\prime} \cong$ is approximately equal to (Epa+Epc)/2. Epa, anodic peak potential and Epc; cathodic peak potential were measured at a scan rate of 20 mV/s.

OSWV frequencies (f) of 15, 30 and 75 Hz (with amplitude of 25 mV and step height of 4 mV) were used for measurements. $E^{\circ\prime}$ was estimated from the intercept of Ep vs. $f^{1/2}$ (Ep represents the peak potential at net peak current) plot for irreversible reactions. For reversible reactions, $E^{\circ\prime}$ is approximately equal to the peak potential at net peak current at a frequency of 15 Hz. Measurement error: ±5 mV.

Example 2

Preparation of blue sensitive emulsion (Blue EM-F). A high chloride silver halide emulsion was precipitated by adding approximately equimolar amounts of silver nitrate and sodium chloride solutions into a reactor vessel containing a gelatin peptizer, p-glutaramidophenyl disulfide and a thioether ripener. Cesium pentachloronitrosyl osmate(III) dopant was added during the silver halide grain formation for most of the precipitation followed by addition of potassium hexacyano ruthenate(II), potassium pentachloro-5-methylthiazole iridate(III), a small amount of KI solution and then shelling to complete the precipitation. The resulting emulsion contained cubic shaped grains of 0.64 μm in edge length size. The emulsion was optimally sensitized in the presence of p-glutaramidophenyl disulfide, a colloidal suspension of aurous sulfide followed by a heat ramp, addition of blue sensitizing dye, D-1, 1-(3-acetamidophenyl)-5-mercaptotetrazole, an optimal amount of Lippmann bromide and potassium hexachloro iridate(IV).

Preparation of green sensitive emulsion (Green EM). A high chloride silver halide emulsion was precipitated by adding approximately equimolar amounts of silver nitrate and sodium chloride solutions into a reactor vessel containing a gelatin peptizer and a thioether ripener. Cesium pentachloronitrosyl osmate(II) dopant was added during the silver halide grain formation for most of the precipitation, followed by potassium pentachloro-5-methylthiazole iridate (III), then shelling without further dopant. The resulting emulsion contained cubic shaped grains of 0.34 μm in edge length size. The emulsion was optimally sensitized in the presence of p-glutaramidophenyl disulfide, a colloidal suspension of aurous sulfide followed by a heat ramp, addition of green sensitizing dye, D-2, an optimal amount of 1-(3-acetamidophenyl)-5-mercaptotetrazole and Lippmann bromide.

Preparation of red sensitive emulsion (Red EM). A high chloride silver halide emulsion was precipitated by adding approximately equimolar amounts of silver nitrate and sodium chloride solutions into a reactor vessel containing a gelatin peptizer and a thioether ripener. Most of the silver halide grain was precipitated without any dopant, followed by addition of potassium hexacyano ruthenate(II), potassium pentachloro-5-methylthiazole iridate(III) and further shelling. The resulting emulsion contained cubic shaped grains of 0.38 μm in edge length size. The emulsion was optimally sensitized in the presence of p-glutaramidophenyl disulfide, potassium bis{1-[3-(2-sulfobenzamido)-phenyl]-5-mercaptotetrazole}aurate(I), sodium thiosulfate, followed by a heat ramp, addition of 1-(3-acetamidophenyl)-5-mercaptotetrazole, potassium bromide and red sensitizing dye, D-3. In addition, an optimal amount of potassium hexachloro iridate(IV) was added during the sensitization process.

The emulsions were combined with dispersions using techniques known in the art. The inventive pyrimidines (N, Q, I, J, K, F, D, and B) in amounts described in Table 2 were added to the yellow coupler dispersion in layer 1 shown in coating format Table 1 below. The resulting light-sensitive silver halide components were applied to polyethylene resin coated paper support as described in the coating format to provide samples 1–9.

Example 3

A blue sensitive emulsion (Blue EM-P) was prepared as in Example 2 except that the silver nitrate solution was introduced in pulses into the precipitation kettle. After four pulses, cesium pentachloronitrosyl osmate(III) was introduced during pulse #5. Potassium hexacyano ruthenate(II), potassium pentachloro-5-methylthiazole iridate(III) were introduced through pulse #6 and potassium iodide was added just prior to pulse #7. The emulsion was optimally sensitized as in Example 1. Pyrimidine compounds (N, Q, P, O, I, J, K, F, D, and B) in amounts described in Table 3 were added to the yellow coupler dispersion in layer 1 as in Example 2.

The green and the red sensitive emulsions were precipitated and sensitized exactly as in Example 2. These emulsions were coated as above and provided samples 11–30.

TABLE 1

COATING FORMAT

| | g/m$^2$ |
|---|---|
| Layer 1 | |
| Gelatin | 1.252 |
| Silver (Blue EM F) | 0.239 |
| YC-1 | 0.416 |
| ST-1 | 0.173 |
| ST-2 | 0.025 |
| ST-3 | 0.099 |
| S-1 | 0.219 |
| HQ-1 | 0.005 |
| H-1 | 0.147 |
| Layer 2 | |
| Gelatin | 0.756 |
| HQ-2 | 0.108 |
| S-2 | 0.198 |
| SQ-1 | 0.032 |
| Layer 3 | |
| Gelatin | 1.264 |
| Silver (Green EM) | 0.101 |
| MC-1 | 0.208 |
| S-2 | 0.112 |
| S-3 | 0.218 |
| ST-3 | 0.040 |
| ST-4 | 0.274 |
| Layer 4 | |
| Gelatin | 0.756 |
| HQ-2 | 0.108 |
| S-2 | 0.198 |
| SQ-1 | 0.032 |
| AWna | 0.057 |
| Layer 5 | |
| Gelatin | 1.326 |
| Silver (Red EM) | 0.202 |
| CC-1 | 0.233 |
| CC-2 | 0.026 |
| Di-n-butyl sebacate | 0.437 |
| Tris(2-ethylhexyl)phosphate | 0.146 |
| UV-1 | 0.356 |
| Tolylthiosulfonate potassium salt | 0.002 |
| Tolylsulfinate potassium salt | 0.0003 |
| Layer 6 | |
| Gelatin | 0.826 |
| UV-1 | 0.204 |
| UV-2 | 0.036 |
| HQ-2 | 0.066 |
| Tris(2-ethylhexyl)phosphate | 0.080 |

TABLE 1-continued

COATING FORMAT

| | g/m$^2$ |
|---|---|
| Layer 7 | |
| Gelatin | 0.648 |
| DC-200 | 0.021 |
| Ludox AM | 0.162 |

Support Polyethylene laminated paper

STRUCTURES

D-1

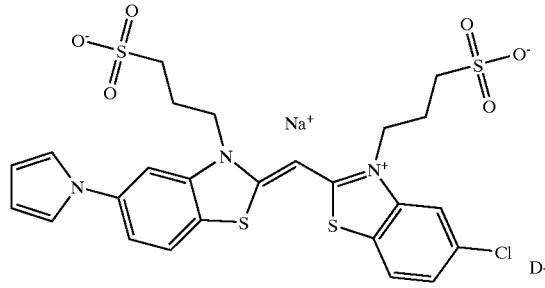

D-2

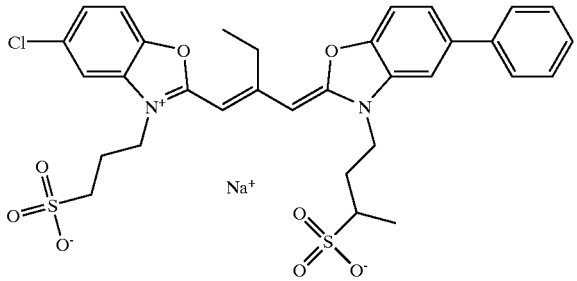

D-3

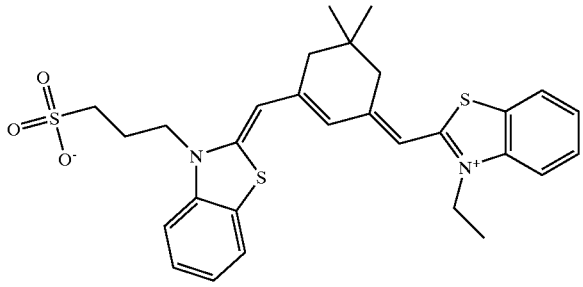

YC-1

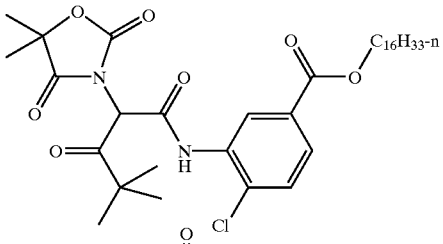

ST-1

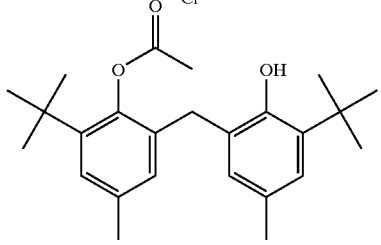

-continued

ST-2

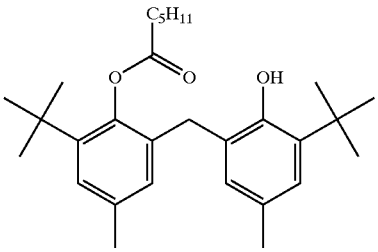

t-Butyl citrate

ST-3

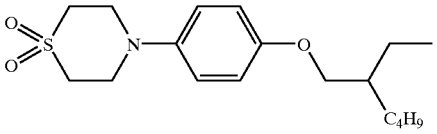

2,5-Dihydroxy-4-(I-methylheptadecyl)-benzenesulphonic acid (K salt)

S-1

Bis (vinylsulphonyl) methane

HQ-1

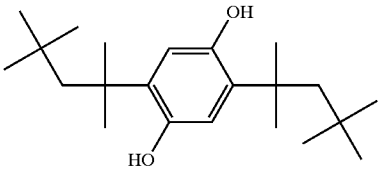

Diundecyl phthalate

H-1

4,5-Dihydroxy-1,3-benzenedisulfonic acid (disodium salt)

HQ-2

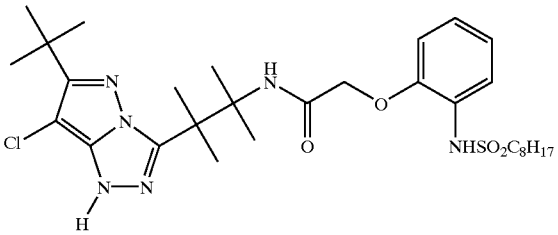

9-Octadecen-1-ol

S-2

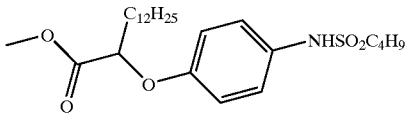

AWna copolymer

SQ-1

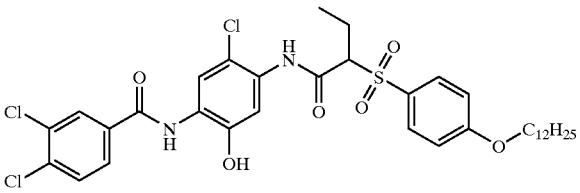

CC-1

-continued

CC-2

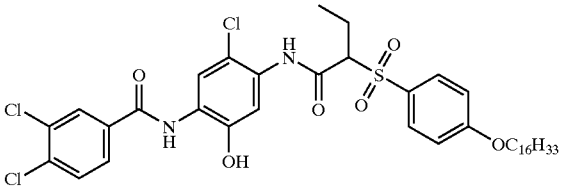

UV-1

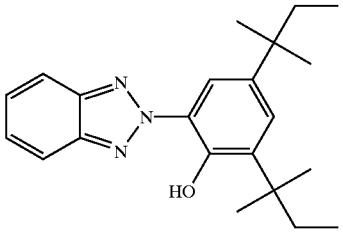

UV-2

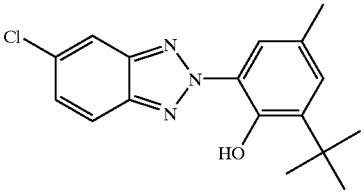

MC-1

S-3

ST-4

The coatings were given a 0.1 second exposure, using a 0–3 step tablet (0. 15 increments) with a tungsten lamp designed to stimulate a color negative print exposure source. This lamp had a color temperature of 3000 K, log lux 2.95, and the coatings were exposed through a combination of magenta and yellow filters, a 0.3 ND (Neutral Density), and a UV filter. The processing consisted of a color development (45 sec, 35° C.), bleach-fix (45 sec, 35° C.) and stabilization or water wash (90 sec, 35° C.) followed by drying (60 sec, 60° C.). The chemistry used in the Colenta processor consisted of the following solutions:

Developer:

| | |
|---|---|
| Lithium salt of sulfonated polystyrene | 0.25 mL |
| Triethanolamine | 11.0 mL |
| N,N-diethylhydroxylamine (85% by wt.) | 6.0 mL |
| Potassium sulfite (45% by wt.) | 0.5 mL |
| Color developing agent (4-(N-ethyl-N-2-methanesulfonyl aminoethyl)-2-methyl-phenylenediaminesesquisulfate monohydrate | 5.0 g |
| Stilbene compound stain reducing agent | 2.3 g |
| Lithium sulfate | 2.7 g |
| Potassium chloride | 2.3 g |
| Potassium bromide | 0.025 g |
| Sequestering agent | 0.8 mL |
| Potassium carbonate | 25.0 g |
| Water to total of 1 liter, pH adjusted to 10.12 | |

Bleach-fix

| | |
|---|---|
| Ammonium sulfite | 58 g |
| Sodium thiosulfate | 8.7 g |
| Ethylenediaminetetracetic acid ferric ammonium salt | 40 g |
| Acetic acid | 9.0 mL |
| Water to total 1 liter, pH adjusted to 6.2 | |

Stabilizer

| | |
|---|---|
| Sodium citrate | 1 g |
| Water to total 1 liter, pH adjusted to 7.2. | |

The speed taken at the 0.8 density point of the D log E curve was taken as a measure of the sensitivity (speed) of the emulsion. Stain was measured as the density in a no exposure area with red, green, and blue filters. The coated emulsions were subject to a storage condition of 120° F. and 50% RH. The changes in speed and stain were recorded as A values compared to identical coatings that are stored at 0° F.

For the latent image keeping test, exposures of 0.5 second each were made with the coated emulsion to a constant nominal density at 21 predetermined time intervals. The shortest latent image delay prior to processing was five seconds and the longest latent image keeping was 2 minutes. Once the final exposure had been made, the coating was automatically fed into the processor. The resulting densities were plotted against a $\log_{10}$ (time) scale and the slope of the regression line was used to predict the delta density for the 5 minute latent image keeping time versus the 30 second latent image time. This density change was reported as ΔD @ 30 s. Another density change obtained by multiplying the slope of the regression line by 1.3 gives the density change for the 5 minute versus the 15 s latent image time, and is reported as ΔD @ 15 s.

TABLE 2

| | | mg/Ag | Fresh | | 4 Week 120° F. |
|---|---|---|---|---|---|
| Sample | Compound | mole | speed | stain | Δ stain |
| (1) Control | None | 0 | 1.72 | 0.075 | 0.088 |
| (2) invention | N | 1080 | 1.71 | 0.078 | 0.059 |
| (3) invention | Q | 1080 | 1.72 | 0.074 | 0.048 |
| (4) invention | I | 1080 | 1.73 | 0.075 | 0.062 |
| (5) invention | J | 1080 | 1.72 | 0.075 | 0.012 |
| (6) invention | K | 1080 | 1.73 | 0.075 | 0.058 |
| (7) invention | F | 1080 | 1.73 | 0.076 | 0.065 |
| (8) invention | D | 1080 | 1.73 | 0.074 | 0.074 |
| (9) invention | B | 1080 | 1.72 | 0.075 | 0.07 |

It can be seen from Table 2 that for the blue emulsion, Blue EM-F, samples of the present invention (2–9) containing pyrimidine compounds show lower stain than the control sample 1 without any hydroxpyrimidine or aminopyrimidine after a storage of 4 weeks at 120° F. More specifically, sample 5 containing compound J has the best stain position relative to the control. These stain improvements are obtained without any degradation in emulsion sensitivity (speed).

Table 3 tabulates the stain data for the emulsion Blue EM-P after a storage of 4 weeks at 120 ° F. Here again, samples 21 and 22 containing compound J of the present invention provide excellent stabilization against fog increase compared to the control sample without the inventive pyrimidines. This stabilization is obtained without any loss in emulsion sensitivity as is demonstrated in Table 2 above. Thus, regardless of how the yellow emulsion was prepared, the pyrimidine compounds of the present invention afford good protection against fog increase.

TABLE 3

| | | mg/Ag | Fresh | | 4 Week 120° F. |
|---|---|---|---|---|---|
| Sample | Compound | mole | speed | stain | Δ stain |
| (10) Control | None | 0 | 1.71 | 0.08 | 0.099 |
| (11) invention | N | 1080 | 1.69 | 0.08 | 0.058 |
| (12) invention | N | 3240 | 1.67 | 0.08 | 0.034 |
| (13) invention | Q | 1080 | 1.71 | 0.08 | 0.057 |
| (14) invention | Q | 3240 | 1.7 | 0.08 | 0.028 |
| (15) invention | P | 1080 | 1.72 | 0.08 | 0.019 |
| (16) invention | P | 3240 | 1.71 | 0.08 | 0.010 |
| (17) invention | O | 540 | 1.75 | 0.08 | 0.086 |
| (18) invention | O | 1512 | 1.75 | 0.08 | 0.056 |
| (19) invention | I | 1080 | 1.71 | 0.08 | 0.067 |
| (20) invention | I | 3240 | 1.71 | 0.08 | 0.052 |
| (21) invention | J | 1080 | 1.7 | 0.08 | 0.013 |
| (22) invention | J | 3240 | 1.69 | 0.08 | 0.017 |
| (23) invention | K | 1080 | 1.7 | 0.08 | 0.067 |
| (24) invention | K | 3240 | 1.7 | 0.08 | 0.049 |
| (25) invention | F | 1080 | 1.71 | 0.08 | 0.068 |
| (26) invention | F | 3240 | 1.71 | 0.08 | 0.068 |
| (27) invention | D | 1080 | 1.71 | 0.08 | 0.073 |
| (28) invention | D | 3240 | 1.71 | 0.08 | 0.085 |
| (29) invention | B | 1080 | 1.71 | 0.08 | 0.083 |

Table 4 tabulates selected pyrimidines of the present invention, their oxidation potentials ($E_{ox}$), and their latent image stabilizing activities at two different latent image keeping times. It can be seen that for the control sample (10) without any pyrimidines, there is a speed gain when the coating was left unprocessed for a short period. When pyrimidines O, I and J are added to the coupler dispersion, the speed increases due to latent image change for samples 17–22 are much less than that of the control sample (10) without pyrimidines or that of an art-known material (MHR) such as in sample 30. Significantly, the pyrimidines O, I and J have Eox values in the 0.2 volt range. Other pyrimidines that are outside of this range afford little to no protection against latent image changes (samples 11–16, 25–29).

TABLE 4

| Sample | Compound | mg/Ag mole | Eox | LIK Δ D @ 15 s | LIK Δ D @ 30 s |
|---|---|---|---|---|---|
| (10) Control | None | 0 | 0 | 0.123 | 0.0943 |
| (30) comparison | MHR | 3240 | 0.29 | 0.101 | 0.0776 |
| (11) | N | 1080 | 0.101 | 0.122 | 0.0941 |
| (12) | N | 3240 | 0.101 | 0.127 | 0.0976 |
| (13) | Q | 1080 | 0.123 | 0.116 | 0.0894 |
| (14) | Q | 3240 | 0.123 | 0.124 | 0.0955 |
| (15) | P | 1080 | 0.129 | 0.0945 | 0.0825 |
| (16) | P | 3240 | 0.129 | 0.109 | 0.0836 |
| (17) | O | 540 | 0.219 | 0.074 | 0.0568 |
| (18) | O | 1512 | 0.219 | 0.072 | 0.0556 |
| (19) | I | 1080 | 0.223 | 0.097 | 0.0744 |
| (20) | I | 3240 | 0.223 | 0.09 | 0.0695 |
| (21) | J | 1080 | 0.227 | 0.088 | 0.0678 |
| (22) | J | 3240 | 0.227 | 0.088 | 0.0679 |
| (25) | F | 1080 | 0.469 | 0.14 | 0.1073 |
| (26) | F | 3240 | 0.469 | 0.117 | 0.0903 |
| (27) | D | 1080 | 0.997 | 0.136 | 0.1045 |
| (28) | D | 3240 | 0.997 | 0.125 | 0.096 |
| (29) | B | 1080 | 1.013 | 0.123 | 0.0947 |

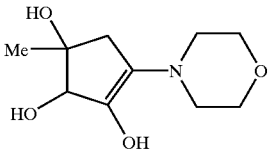

(MHR)

The invention has been described in detail with particular reference to the preferred embodiments thereof, but it will be understood that variations and modifications can be effected within the scope of the invention.

What is claimed is:

1. A negative silver halide photographic element comprising a silver halide emulsion which is greater than 50 mole % silver chloride, a dye forming coupler which reacts with oxidized color developing agent to form dye, and a pyrimidine compound represented by Formula I (I)

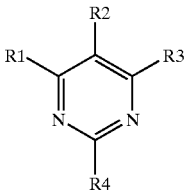

wherein $R_1$, $R_2$, and $R_3$ are each independently a hydrogen atom or a hydroxy, alkoxy, amino, alkylamino, cyanoamino or alkyl group, and $R_4$ is a hydroxy, alkoxy, alkylamino, cyanoamino or alkyl group; provided that at least one of $R_1$, $R_2$, $R_3$, and $R_4$ is a hydroxy or an amino group.

2. The silver halide photographic element of claim 1 wherein at least two of $R_1$, $R_2$, $R_3$, and $R_4$ are a hydroxy or an amino group.

3. The silver halide photographic element of claim 1 wherein at least one of $R_1$, $R_2$, $R_3$, and $R_4$ is an amino group adjacent to a hydroxy group.

4. The silver halide photographic element of claim 1 wherein the oxidation potential of the pyrimidine compound is 0.2 to 0.25 V.

5. The silver halide photographic element of claim 2 wherein the oxidation potential of the pyrimidine compound is 0.2 to 0.25 V.

6. The silver halide photographic element of claim 1 wherein the silver halide emulsion is greater than 90 mole % silver chloride.

7. The silver halide photographic element of claim 2 wherein the silver halide emulsion is greater than 90 mole % silver chloride.

8. The silver halide photographic element of claim 1 wherein said element comprises a support bearing a cyan dye image-forming unit comprised of at least one red-sensitive silver halide emulsion layer having associated therewith at least one cyan dye-forming coupler, a magenta dye image-forming unit comprising at least one green-sensitive silver halide emulsion layer having associated therewith at least one magenta dye-forming coupler, and a yellow dye image-forming unit comprising at least one blue-sensitive silver halide emulsion layer having associated therewith at least one yellow dye-forming coupler.

9. The silver halide photographic element of claim 8 wherein the pyrimidine compound is contained in the yellow dye image-forming unit.

* * * * *